US005598584A

United States Patent [19]

Da Grossa

[11] Patent Number: 5,598,584

[45] Date of Patent: Feb. 4, 1997

[54] DESIGNER FINGERNAIL GLOVES

[76] Inventor: Darrin P. Da Grossa, 71-25 244th St., Douglaston, N.Y. 11362

[21] Appl. No.: 193,995

[22] Filed: Feb. 9, 1994

[51] Int. Cl.[6] ..... A41D 19/00

[52] U.S. Cl. ..... 2/159; 2/163; 2/164

[58] Field of Search ..... 2/159, 163, 164; 132/285

[56] References Cited

U.S. PATENT DOCUMENTS

| | | | |
|---|---|---|---|
| D. 106,139 | 9/1937 | Larom | 2/163 X |
| 556,581 | 3/1896 | Loewenstine | 2/163 |
| 2,283,703 | 5/1942 | Stedman | 132/285 |
| 2,513,030 | 6/1950 | Lazarian | 2/159 |
| 2,725,570 | 12/1955 | Penna | 2/163 |
| 3,128,472 | 4/1964 | Raney | 2/159 |
| 3,501,773 | 3/1970 | Stansberry et al. | 2/159 |
| 4,907,297 | 3/1990 | Gallucci | 21/163 |
| 5,140,709 | 8/1992 | Cohn et al. | 21/163 |

*Primary Examiner*—C. D. Crowder
*Assistant Examiner*—Shirra L. Jenkins
*Attorney, Agent, or Firm*—Richard L. Miller, P.E.

[57] ABSTRACT

A designer fingernail glove is provided and consists of a palm portion for covering a palm of a hand of a wearer. A plurality of finger stalls communicate with the palm portion for covering the fingers of the hand. The finger stalls have top openings at their distal ends, to align with elongated fingernails on the fingers. Components are for expanding the top openings, when the elongated fingernails are inserted through the top openings. The top openings will fit snugly about the elongated fingernails, to prevent water and dirt from entering the finger stalls.

2 Claims, 2 Drawing Sheets

24
22
20
26
16
10
12
22
24
20
26
16
10
12

22
6
26
20
6

24
10
16
18
14
12

24
26
22
20
36
16
10
12

26
20
24
22
16

18

24
20
16
22

26

22
26
20
8
40
38
36
7
16
7

22
32
20
26
8
8
38
16
40
36

DESIGNER FINGERNAIL GLOVES

BACKGROUND OF THE INVENTION

The instant invention relates generally to gloves and more specifically it relates to a designer fingernail glove.

Numerous gloves have been provided in prior art that are adapted to include openings in the finger stalls to expose the fingernails of the wearer. For example, U.S. Pat. Nos. 2,725,570 to Penna; 4,907,297 to Gallucci and 5,140,709 to Cohn et al. all are illustrative of such prior art. While these units may be suitable for the particular purpose to which they address, they would not be as suitable for the purposes of the present invention as heretofore described.

SUMMARY OF THE INVENTION

A primary object of the present invention is to provide a designer fingernail glove that will overcome the shortcomings of the prior art devices.

Another object is to provide a designer fingernail glove in which openings in the finger stalls are reinforced with elastic rings, so that when fingernails extend through the openings the elastic rings will adjust the openings to the size of the fingernails.

An additional object is to provide a designer fingernail glove that will keep the hand of a woman warm in winter, while still allow her to show off her long nails.

A further object is to provide a designer fingernail glove that is simple and easy to use.

A still further object is to provide a designer fingernail glove that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
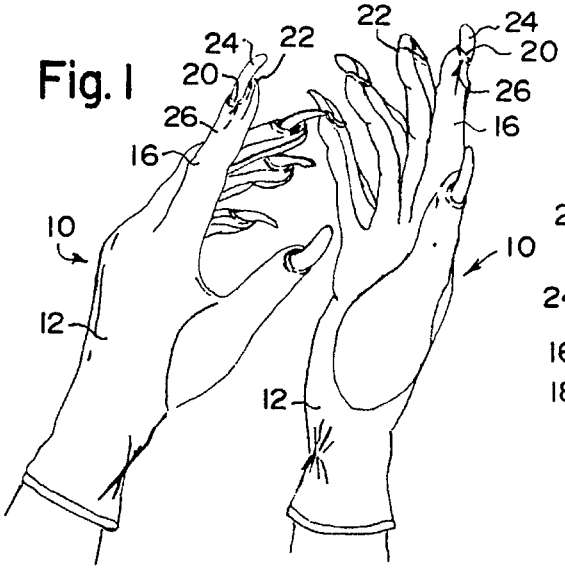
FIG. 1 is a diagrammatic perspective view of the instant invention donned on a person's hands.
Figure 2:
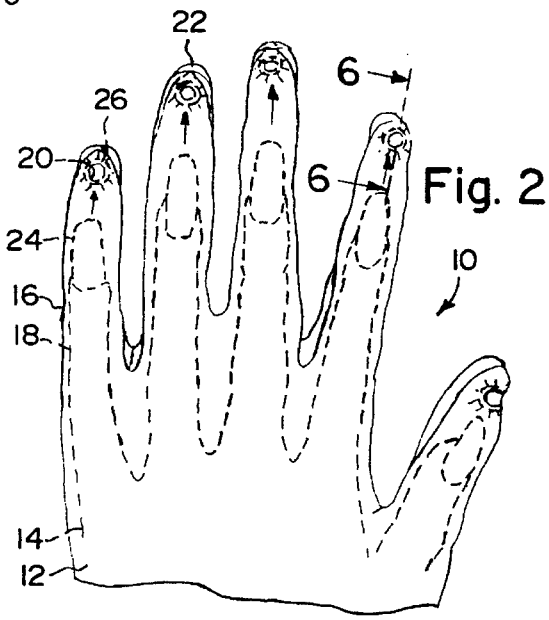
FIG. 2 is an enlarged diagrammatic plan view with parts broken away illustrating a hand with the glove being donned thereon.
Figure 3:
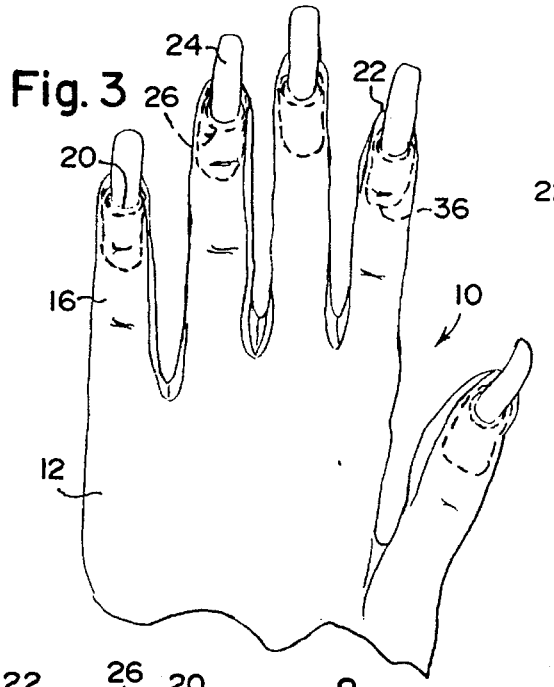
FIG. 3 is an enlarged diagrammatic plan view with parts broken away illustrating a hand with the glove fully donned thereon.
Figure 4:
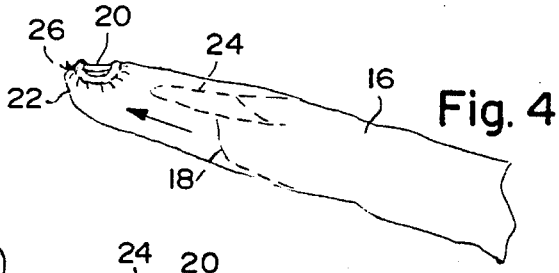
FIG. 4 is an enlarged diagrammatic perspective view of a single finger stall of the instant invention showing the construction thereof in greater detail with a finger being inserted therein.
Figure 5:
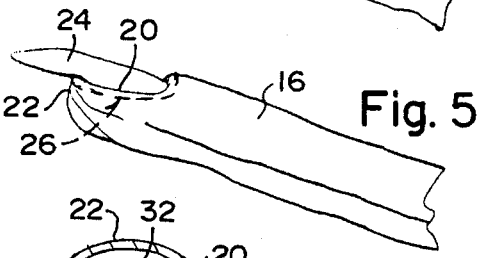
FIG. 5 is a view similar to FIG. 4 with the finger fully installed therein.
Figure 6:
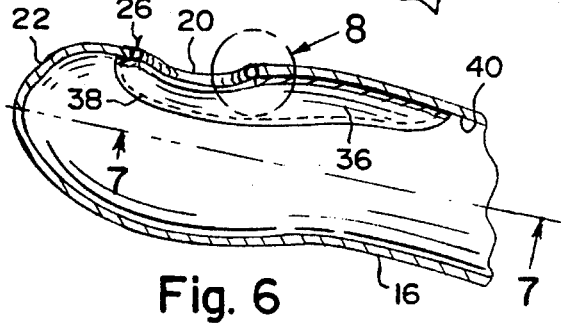
FIG. 6 is a greatly enlarged partial cross sectional view taken on line 6—6 of FIG. 2.
Figure 7:
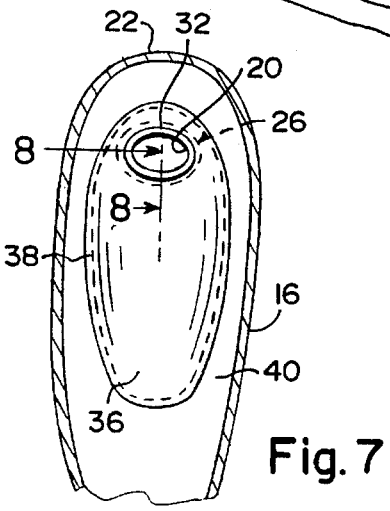
FIG. 7 is a cross sectional view taken on line 7—7 of FIG. 6.

Turning now descriptively to the drawings, in which similar reference characters denote similar elements throughout the several views, FIGS. 1 through 7 illustrate a designer fingernail glove 10, consisting of a palm portion 12 for covering a palm of a hand 14 of a wearer. A plurality of finger stalls 16 communicate with the palm portion 12, for covering the fingers 18 of the hand 14. The finger stalls 16 have top openings 20 at their distal ends 22, to align with elongated fingernails 24 on the fingers 18. Components 26 are for expanding the top openings 20, when the elongated fingernails 24 are inserted through the top openings 20. The top openings 20 will fit snugly about the elongated fingernails 24, to prevent water and dirt from entering the finger stalls 16.

Figure 8:
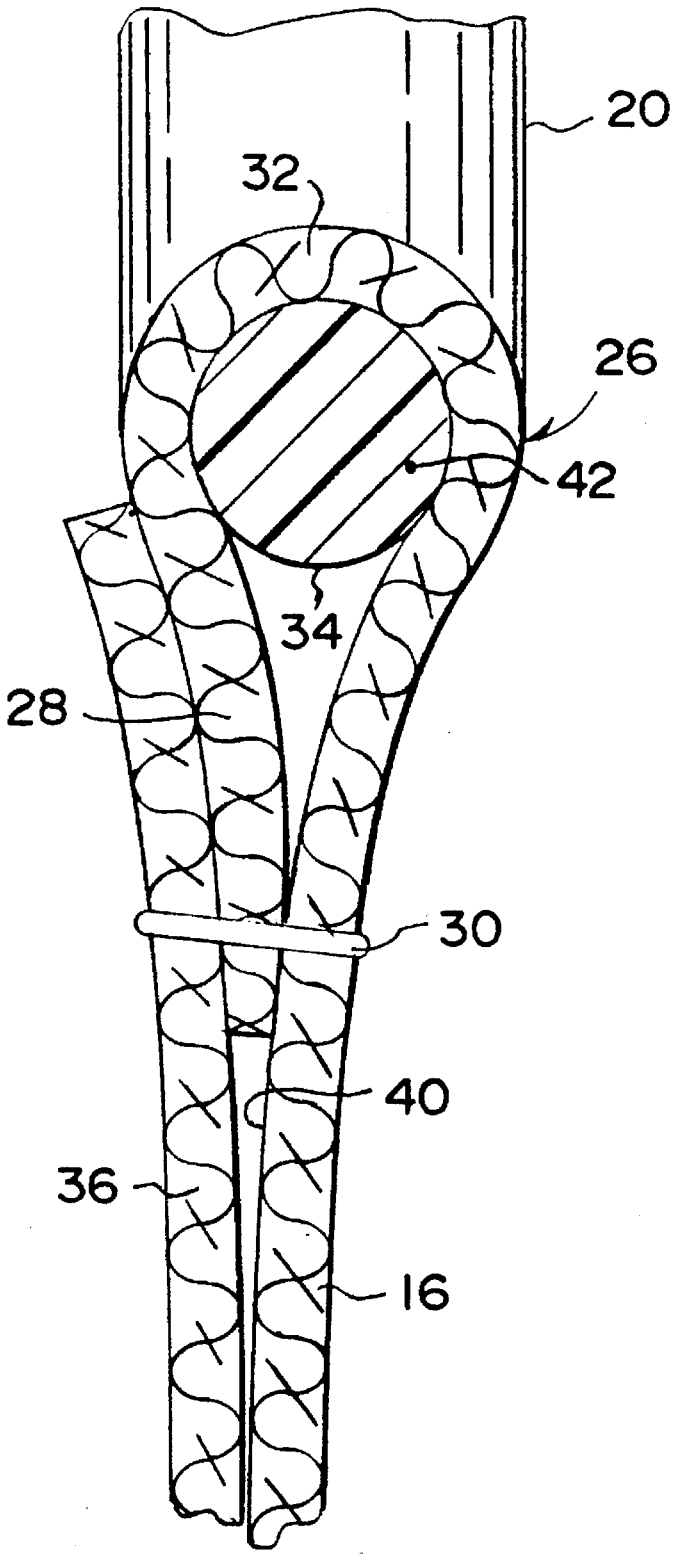
FIG. 8 is a still further enlarged cross sectional view with parts broken away taken on line 8—8 of FIG. 7.

The expanding components 26 contains the finger stalls 16 16 having portion 28 folded over and secured by stitching 30 about the top openings 20 to form tubular beads 32. A plurality of elastic rings 34 are provided with each located in one tubular bead 32 (see FIG. 8).

A plurality of liners 36 are provided with each secured by stitching 38 to an inner top wall 40 of each finger stall 16. The liner 36 will cover the portion 28 of the finger stall 16, forming the tubular bead 32 about the top openings 20, to protect and guide the elongated fingernail 24 as it moves towards the top opening 20.

Each elastic ring 34 is fabricated out of a stretchable rubber material 42. The glove 10 may be made of leather, fabric, suede, cotton, knit materials, lace or any other suitable glove making material. The glove 10 is made with the ordinary palm portion 12 and with individual stalls 16, for the fingers 18 and a separate stall for the thumb of the wearer.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A designer fingernail glove comprising:

a) a palm portion for covering a palm of a hand of a wearer;

b) a plurality of finger stalls communicating with said palm portion for covering the fingers of the hand and having tapering distal ends;

c) said finger stalls having top openings at their distal ends to align with elongated fingernails on the fingers;

d) means for expanding said top openings when the elongated fingernails are inserted through said top openings comprising portions of said finger stalls folded over into respective finger stalls and secured by stitching about said top openings to form tubular beads with inner exposed edges;

e) a plurality of elastic rings, each located in one said tubular bead, so that said top openings will fit snugly about the elongated fingernails, to prevent water and dirt from entering said finger stalls, and f) further including a plurality of liners, each secured by a stitching to an inner top wall of each said finger stall and extending toward said palm portion, so that said liner will cover inner exposed edge of said portion of said finger stall forming said tubular bead about said top opening to protect and guide the elongated fingernail as it moves towards said top opening preventing said fingernail catching on an inner exposed edge during insertion movement of a finger along the finger stall.

2. A designer fingernail glove as recited in claim 1, wherein each said elastic ring is fabricated out of a stretchable rubber material.

* * * * *